US007700252B2

(12) United States Patent
Silence et al.

(10) Patent No.: US 7,700,252 B2
(45) Date of Patent: Apr. 20, 2010

(54) DUAL PIGMENT TONER COMPOSITIONS

(75) Inventors: Scott M. Silence, Fairport, NY (US); James M. Proper, Webster, NY (US); Zhaoyi M. Masucci, Penfield, NY (US); Beatriz C. Custode, Webster, NY (US); Maria M. Barden, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 658 days.

(21) Appl. No.: 11/602,555

(22) Filed: Nov. 21, 2006

(65) Prior Publication Data

US 2008/0138731 A1 Jun. 12, 2008

(51) Int. Cl.
*G03G 9/00* (2006.01)

(52) U.S. Cl. ..... 430/108.23; 430/45.1

(58) Field of Classification Search ..... 430/108.23, 430/45.1

See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti et al. |
| 3,655,374 | A | 4/1972 | Palermiti et al. |
| 3,674,736 | A | 7/1972 | Lerman et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,375,673 | A | 3/1983 | Lewis et al. |
| 4,394,430 | A | 7/1983 | Jadwin et al. |
| 4,560,635 | A | 12/1985 | Hoffend et al. |
| 4,797,339 | A | 1/1989 | Maruyama et al. |
| 4,935,326 | A | 6/1990 | Creatura et al. |
| 4,937,166 | A | 6/1990 | Creatura et al. |
| 4,983,488 | A | 1/1991 | Tan et al. |
| 4,996,127 | A | 2/1991 | Hasegawa et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,554,471 | A | 9/1996 | Bertrand et al. |
| 5,556,727 | A | 9/1996 | Ciccarelli et al. |
| 5,585,215 | A | 12/1996 | Ong et al. |
| 5,591,552 | A | 1/1997 | Ciccarelli et al. |
| 5,607,804 | A | 3/1997 | Bertrand et al. |
| 5,620,820 | A | 4/1997 | Bertrand et al. |

(Continued)

*Primary Examiner*—Mark A Chapman
(74) *Attorney, Agent, or Firm*—Carter, DeLuca, Farrell & Schmidt, LLP

(57) ABSTRACT

Dual pigment compositions are provided that include a first pigment based upon a xanthene dye and a second pigment based upon a monoazo dye. The pigment compositions of the present disclosure may be combined with a binder resin to form a toner, in embodiments a magenta toner.

10 Claims, 6 Drawing Sheets

U.S. PATENT DOCUMENTS 5,650,255 A 7/1997 Ng et al.
5,650,256 A 7/1997 Veregin et al.
5,688,626 A 11/1997 Patel et al.
5,853,943 A 12/1998 Cheng et al.
5,866,288 A * 2/1999 Ciccarelli et al. ..... 430/45.4
5,978,633 A 11/1999 Hirsch et al.
6,004,714 A 12/1999 Ciccarelli et al.
6,190,815 B1 2/2001 Ciccarelli et al.
6,455,215 B1 * 9/2002 Hashimoto et al. ..... 430/108.23
2003/0162116 A1 * 8/2003 Katsuta et al. ..... 430/108.23
2003/0207995 A1 * 11/2003 Kameoka ..... 525/165

* cited by examiner

DUAL PIGMENT TONER COMPOSITIONS

BACKGROUND

The present disclosure relates generally to pigments utilized in toners and, more specifically, to combinations of pigments possessing excellent color reproducibility and lightfastness.

Numerous processes are known for the preparation of toners, such as, for example, conventional processes wherein a resin is melt kneaded or extruded with a pigment, micronized and pulverized to provide toner particles. There are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

Toner can also be produced by emulsion aggregation methods. Methods of preparing an emulsion aggregation (EA) type toner are known and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. In particular, the '943 patent describes a process including: (i) conducting a pre-reaction monomer emulsification which includes emulsification of the polymerization reagents of monomers, chain transfer agent, a disulfonate surfactant or surfactants, and optionally, but in embodiments, an initiator, wherein the emulsification is accomplished at a low temperature of, for example, from about 5° C. to about 40° C.; (ii) preparing a seed particle latex by aqueous emulsion polymerization of a mixture including (a) part of the monomer emulsion, from about 0.5 to about 50 percent by weight, or from about 3 to about 25 percent by weight, of the monomer emulsion prepared in (i), and (b) a free radical Initiator, from about 0.5 to about 100 percent by weight, or from about 3 to about 100 percent by weight, of the total initiator used to prepare the latex polymer at a temperature of from about 35° C. to about 125° C., wherein the reaction of the free radical initiator and monomer produces the seed latex comprised of latex resin wherein the particles are stabilized by surfactants; (iii) heating and feed adding to the formed seed particles the remaining monomer emulsion, from about 50 to about 99.5 percent by weight, or from about 75 to about 97 percent by weight, of the monomer emulsion prepared In (ii), and optionally a free radical initiator, from about 0 to about 99.5 percent by weight, or from about 0 to about 97 percent by weight, of the total Initiator used to prepare the latex polymer at a temperature from about 35° C. to about 125° C.; and (iv) retaining the above contents in the reactor at a temperature of from about 35° C. to about 125° C. for an effective time period to form the latex polymer, for example from about 0.5 to about 8 hours, or from about 1.5 to about 6 hours, followed by cooling. Other examples of emulsion/aggregation/coalescing processes for the preparation of toners are illustrated in U.S. Pat. Nos. 5,290,654, 5,278,020, 5,308,734, 5,370,963, 5,344,738, 5,403,693, 5,418,108, 5,364,729, and 5,346,797, the disclosures of each of which are hereby incorporated by reference in their entirety. Other processes are disclosed in U.S. Pat. Nos. 5,348,832, 5,405,728, 5,366,841, 5,496,676, 5,527,658, 5,585,215, 5,650,255, 5,650,256 and 5,501,935, the disclosures of each of which are hereby incorporated by reference in their entirety.

Color toners are also within the purview of those skilled in the art. In U.S. Pat. Nos. 5,556,727, 5,591,552, 5,554,471, 5,607,804, 5,620,820, and 5,688,626, the disclosures of each of which are hereby incorporated by reference in their entirety, there is illustrated a combination of four color toners for the development of electrostatic latent images enabling the formation of a full color gamut image, wherein the four toners include a cyan toner, a magenta toner, a yellow toner, and a black toner. Each of these toners include a resin and pigment.

Improved methods for producing toner, which improve the reproducibility and the lightfastness of the color, remain desirable.

SUMMARY

The present disclosure provides dual pigment compositions which include a first pigment based upon a xanthene dye and a second pigment based upon a monoazo dye. In embodiments, the first pigment may include C.I. Pigment Red 81:2, C.I. Pigment Red 81:1, C.I. Pigment Red 81:3, C.I. Pigment Red 81:4, C.I. Pigment Red 81:5, C.I. Pigment Red 81:6, and combinations thereof. In other embodiments, the second pigment may include C.I. Pigment Red 57:1, C.I. Pigment Red 57, C.I. Pigment Red 57:2, C.I. Pigment Red 57:3, and combinations thereof.

The present disclosure also provides toners including such dual pigment compositions. In embodiments, a toner of the present disclosure may include at least one binder resin and a dual pigment composition including a first pigment including a xanthene dye and a second pigment including a monoazo dye. In embodiments, the binder resin of such a toner may include styrene acrylates, styrene butadienes, styrene methacrylates, and combinations thereof. In other embodiments, the binder resin of such a toner may include a combination of a linear propoxylated bisphenol A fumarate and a cross-linked propoxylated bisphenol A fumarate.

In other embodiments, the present disclosure provides toners which may include at least one binder resin, and a dual pigment composition including C.I. Pigment Red 81:2 and C.I. Pigment Red 57:1, wherein the weight ratio of C.I. Pigment Red 81:2 to C.I. Pigment Red 57:1 is from about 30:70 to about 80:20.

BRIEF DESCRIPTION OF THE DRAWINGS

Various embodiments of the present disclosure will be described herein below with reference to the figures wherein.

DETAILED DESCRIPTION

Figure 1:
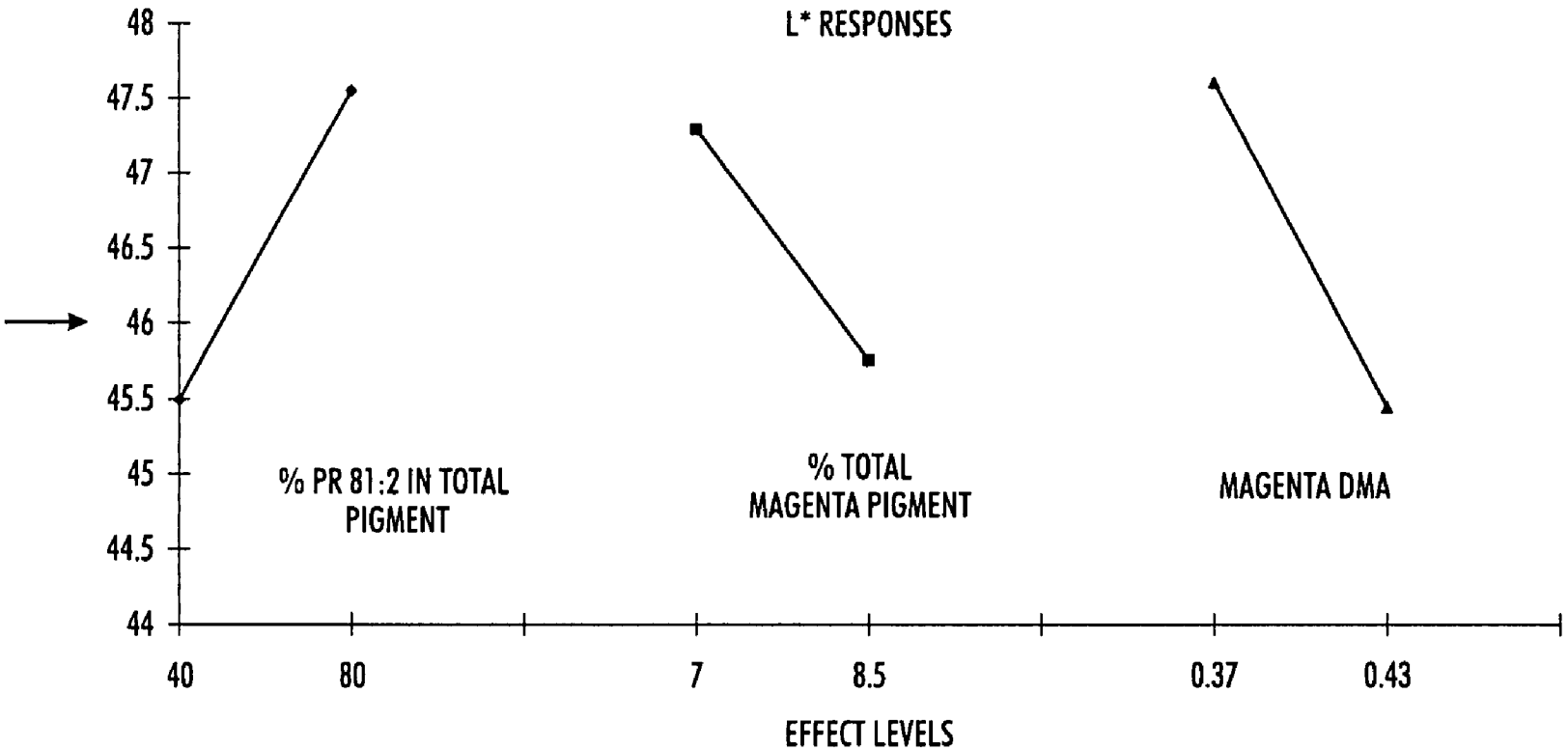
FIG. 1 is a graph depicting marginal means plots of lightness (L*) for a magenta toner possessing dual pigment compositions of the present disclosure.

In accordance with the present disclosure, dual pigment compositions are provided which are suitable for use in toners. Such toners may be useful in xerographic development systems used to generate full process color copies, such as the generation of developed colored images in the systems from Xerox Corporation including 5750®, 5790®, DC2045®, DC2060®, DC12®, and iGEN-3®. The dual pigment composition of the present disclosure may be utilized with any resin and/or latex useful as a toner. Suitable toners include, for example, toners produced by conventional processes as well as those produced by emulsion aggregation methods.

The dual pigment compositions of the present disclosure may, in embodiments, be useful in the preparation of magenta toners. Such magenta toners may, in embodiments, be utilized in color xerographic machines to form color images, including images possessing red colors. Toners possessing the dual pigment composition of the present disclosure exhibit excellent color characteristics, including both color reproducibility and lightfastness.

In accordance with the present disclosure, the first pigment in the dual pigment composition may include a pigment based on a xanthene dye. Suitable pigments which may be used as the first pigment are within the purview of those skilled in the art and include, for example, C.I. Pigment Red 81:2 (PR 81:2), C.I. Pigment Red 81:1 (PR 81:1), C.I. Pigment Red 81:3 (PR 81:3), C.I. Pigment Red 81:4 (PR 81:4), C.I. Pigment Red 81:5 (PR 81:5), C.I. Pigment Red 81:6 (PR 81:6), and combinations thereof. In embodiments, PR81:2, a silicomolybdic acid salt possessing a methyl ester substituent (—COOCH3), may be used as a first pigment. PR81:2 is a silicomolybdic acid salt of

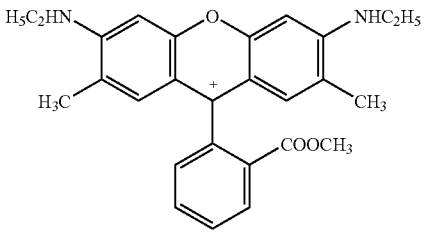

In accordance with the present disclosure, it has been discovered that the use of pigments based upon xanthene dyes in the dual pigment composition of the present disclosure impart better lightfastness and color reproducibility properties to a toner possessing such pigment compared with toners possessing other pigments, for example toners possessing pigments based upon rhodamine dyes.

In accordance with the present disclosure, the second pigment of the dual pigment composition may include monoazo dye based pigments. Such pigments are within the purview of those skilled in the art and include, for example, C.I. Pigment Red 57:1 (PR57:1), C.I. Pigment Red 57 (PR 57), C.I. Pigment Red 57:2 (PR 57:2), C.I. Pigment Red 57:3 (PR 57:3), and combinations thereof. In embodiments PR57:1 may be utilized as the second pigment. PR57:1 has the following structure

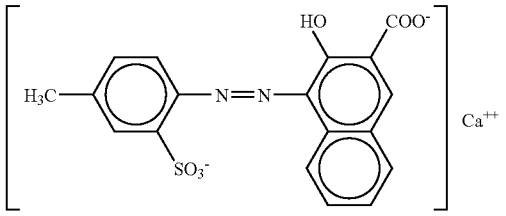

In embodiments, the dual pigment composition of the present disclosure may include PR81:2 as the first pigment and PR57:1 as the second pigment.

The first pigment and the second pigment may be combined utilizing any methods within the purview of those skilled in the art in order to form a dual pigment composition of the present disclosure. Suitable methods include, for example, blending dry pigments together, or blending flushed pigments, or blending a dry pigment and a flushed pigment, or using flushed pigment mixture, and combinations thereof, prior to toner processing. Flushed pigments may be used, in embodiments, to achieve excellent pigment dispersion in the final toner. To prepare the flushed pigment, a wet pigment, or wet cake, is selected followed by heating to melt the resin to render it molten, and then shearing. Water is removed or substantially removed from the pigment, and there is generated a polymer phase around the pigment enabling, for example, substantial, partial passivation of the pigment. A solvent can be added to the product obtained to provide a high quality dispersion of pigment and resin, and the pigment may be present in an amount of from about 25 to about 70 weight percent of the total resin, in embodiments from about 30 to about 50 weight percent with respect to the weight of the resin component.

The amounts of the first pigment and second pigment in the dual pigment composition of the present disclosure may be adjusted depending upon the binder resin. The dual pigment composition is to be utilized with to form the toner, the xerographic machine the toner is intended to be used in, and the like. In embodiments, the weight ratio of the first pigment to the second pigment in the dual pigment composition of the present disclosure may be from about 30:70 to about 80:20, in embodiments from about 40:60 to about 70:30.

Currently, red colors (hue angles from about 15 to about 60 degrees) from some color xerographic machines, for example the iGEN3® system from Xerox Corporation, may be obtained by combining magenta and yellow toners so that the resulting red color may have a lightness (L*) in the range of from about 30 to about 60 (L* units represent the differential response of the human eye to a developed image and are used as a metric for density variation), which is smaller than the colors found in the SWOP® standards or the GRACoL® standards. (The colors produced by a typical offset press can be found in the definition of the Specification for Web Offset Printing (SWOP®) standards, provided by the Graphics Arts Technical Foundation (GATF), and the General Requirements for Applications in Commercial offset Lithography (GRACoL®) standards, provided by the Printing Industries of America.)

The dual pigment compositions of the present disclosure may be utilized to produce toners possessing color properties that have not been previously achieved with other single magenta pigments or other combinations of two magenta pigments. Toners possessing the dual pigment compositions of the present disclosure may produce colors having properties similar to those produced by current xerographic machines and, in embodiments, may produce colors within the SWOP® standards and/or the GRACoL® standards. For example, toners made with the pigment combination of the present disclosure are a close match to GRACoL red target and have minimal loss of gamut volume relative to currently used magenta toners. Moreover, toners possessing the dual pigment composition of the present disclosure possess excellent lightfastness that is equivalent or superior to that of the industry standard, which is the PR57:1 pigment.

The lightfastness behavior of the dual pigment compositions of the present disclosure moves the hue in opposite directions so that the two pigments utilized to form the dual pigment composition offset each other to maintain hue, leading to a lightfastness level greater than conventional toners, including those currently in use in the iGEN developers from Xerox. High chroma reds may be achieved without much loss of other parts of the gamut, which is important in achieving the GRACoL industry standard.

The dual pigment composition of the present disclosure may be combined with any suitable resin to form a magenta toner. The dual pigment composition of the present disclosure may be present in a magenta toner in amounts from about 0.5 to about 20 percent by weight of the toner, in embodiments from about 3 to about 12 percent by weight of the toner.

As noted above, any suitable resin may be utilized to form a toner of the present disclosure. Suitable toners include those produced by both conventional methods and those produced by emulsion aggregation or any other chemical toner preparation methods.

In embodiments, the binder resin may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and mixtures thereof. In embodiments, the polymer is poly (styrene/butyl acrylate/beta carboxyl ethyl acrylate). The polymer may be block, random, or alternating copolymers.

In embodiments, the binder resin may be derived from the polymerization of monomers including, but not limited to, styrenes, butadienes, isoprenes, acrylates, methacrylates, acrylonitriles, acrylic acid, methacrylic acid, itaconic or beta carboxy ethyl acrylate (β-CEA) and the like.

In embodiments, the binder resin may include linear polyesters, cross-linked polyesters, or a combination thereof. Linear unsaturated polyesters used as the binder resin may include low molecular weight condensation polymers which may be formed by the step-wise reactions between both saturated and unsaturated diacids or anhydrides and dihydric alcohols such as glycols or diols. The resulting unsaturated polyesters may be reactive, e.g., cross-linkable, on two fronts: (i) unsaturation sites (double bonds) along the polyester chain, and (ii) functional groups such as carboxyl, hydroxy, and the like, and similar groups amenable to acid-base reactions. Suitable unsaturated polyester resins which may be useful may be prepared by melt polycondensation or other polymerization processes using diacids and/or anhydrides and diols. Suitable diacids and dianhydrides include, but are not limited to, saturated diacids and/or anhydrides such as, for example, succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides such as, for example, maleic acid, fumaric acid, chloromaleic acid, methacrylic acid, acrylic acid, itaconic acid, citraconic acid, mesaconic acid, maleic anhydride, and the like, and mixtures thereof. Suitable diols include, but are not limited to, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof, which may be soluble, in embodiments, in solvents such as, for example, tetrahydrofuran, toluene and the like.

In embodiments, unsaturated polyester binder resins may be prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. In some embodiments a suitable polyester includes poly(propoxylated bisphenol A fumarate).

Suitable linear polyesters include, in embodiments, linear propoxylated bisphenol A fumarates. Suitable cross-linked polyesters include, in embodiments, cross-linked propoxylated bisphenol A fumarates. The linear polyester may be present in amounts from about 70% to about 98% by weight of the binder resin, in embodiments from about 85% to about 95% by weight of the binder resin, while the cross-linked polyester may be present in amounts from about 2% to about 30% by weight of the binder resin, in embodiments from about 5% to about 15% by weight of the binder resin.

In embodiments, the latex may be prepared by a batch or a semicontinuous emulsion aggregation polymerization resulting in submicron non-crosslinked resin particles suspended in an aqueous phase containing a surfactant. Surfactants which may be utilized in the latex dispersion can be ionic or nonionic surfactants in an amount of from about 0.01 to about 15, and in embodiments of from about 0.01 to about 5 weight percent of the solids.

Anionic surfactants which may be utilized include sulfates and sulfonates such as sodium dodecylsulfate (SDS), sodium dodecyl benzene sulfonate, sodium dodecylnaphthalene sulfate, dialkyl benzenealkyl sulfates and sulfonates, abitic acid, and the NEOGEN brand of anionic surfactants. In embodiments suitable anionic surfactants include NEOGEN RK available from Daiichi Kogyo Seiyaku Co. Ltd., or TAYCA POWER BN2060 from Tayca Corporation (Japan), which are branched sodium dodecyl benzene sulfonates.

Examples of cationic surfactants include ammoniums such as dialkyl benzene alkyl ammonium chloride, lauryl trimethyl ammonium chloride, alkylbenzyl methyl ammonium chloride, alkyl benzyl dimethyl ammonium bromide, benzalkonium chloride, $C_{12}$, $C_{15}$, $C_{17}$ trimethyl ammonium bromides, mixtures thereof, and the like. Other cationic surfactants include cetyl pyridinium bromide, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. In embodiments a suitable cationic surfactant includes SANISOL B-50 available from Kao Corp., which is primarily a benzyl dimethyl alkonium chloride.

Exemplary nonionic surfactants include alcohols, acids, celluloses and ethers, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. In embodiments a suitable nonionic surfactant is ANTAROX 897 available from Rhone-Poulenc Inc., which is primarily an alkyl phenol ethoxylate.

In embodiments, the resin of the latex may be prepared with initiators, such as water soluble initiators and organic soluble initiators. Initiators can be added in suitable amounts, such as from about 0.1 to about 8 weight percent, and in embodiments of from about 0.2 to about 5 weight percent of the monomers.

Known chain transfer agents can also be utilized to control the molecular weight properties of the resin if prepared by emulsion polymerization.

To produce a toner of the present disclosure, the binder resin may be added to a colorant dispersion possessing the dual pigment composition of the present disclosure. A colorant dispersion may include, for example, submicron colorant particles having a size of, for example, from about 50 to about 500 nanometers, and in embodiments of from about 100 to about 400 nanometers in volume average diameter. The colorant particles may be suspended in an aqueous water phase containing an anionic surfactant, a nonionic surfactant, or mixtures thereof. In embodiments, the surfactant may be ionic and from about 1 to about 25 percent by weight, in embodiments from about 4 to about 15 percent by weight of the colorant. Alternatively, the pigment may be combined into the binder resin by conventional melt mix extrusion technology.

A magenta toner of the present disclosure may be utilized in combination with other color toners, i.e., other toners prepared from a binder resin as described above with a different colorant. Colorants include pigments, dyes, mixtures of pigments and dyes, mixtures of pigments, mixtures of dyes, and the like. The colorant may be, for example, carbon black, cyan, yellow, red, orange, brown, green, blue, violet or mixtures thereof.

In embodiments wherein the other colorant is a pigment, the pigment may be, for example, carbon black, phthalocyanines, quinacridones or RHODAMINE B™ type, red, green, orange, brown, violet, yellow, fluorescent colorants and the like. In embodiments, an additional magenta toner may be prepared in addition to the magenta toner prepared with the dual pigment composition of the present disclosure.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido)phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 3 to about 12 weight percent of the toner.

Toner compositions of the present disclosure may further include a wax with a melting point of from about 70° C. to about 95° C., and in embodiments of from about 75° C. to about 93° C. The wax enables toner cohesion and prevents the formation of toner aggregates. In embodiments, the wax may be in a dispersion. Wax dispersions suitable for use in forming toners of the present disclosure include, for example, submicron wax particles having a size of from about 50 to about 500 nanometers, in embodiments of from about 100 to about 400 nanometers in volume average diameter. The wax particles may be suspended in an aqueous phase of water and an ionic surfactant, nonionic surfactant, or mixtures thereof. The ionic surfactant or nonionic surfactant may be present in an amount of from about 0.5 to about 10 percent by weight, and in embodiments of from about 1 to about 5 percent by weight of the wax.

The wax dispersion according to embodiments of the present disclosure may include any suitable wax such as a natural vegetable wax, natural animal wax, mineral wax and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoroethylene wax, polyethylene wax, polypropylene wax, and mixtures thereof. In embodiments, the wax may be a modified wax such as a montan wax derivative, paraffin wax derivative, and/or microcrystalline wax derivative, and combinations thereof.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537, and 538, all available from Johnson Diversey, Inc, or chlorinated polypropylenes and polyethylenes commercially available from Allied Chemical and Petrolite Corporation and Johnson Diversey, Inc.

The wax may be present in an amount of from about 1 to about 30 percent by weight, in embodiments from about 2 to about 20 percent by weight of the toner. In some embodiments, where a polyethylene wax is used, the wax may be present in an amount of from about 8 to about 14 percent by weight, in embodiments from about 10 to about 12 percent by weight of the toner.

The resultant blend of latex, colorant dispersion, and wax dispersion, if present, may be stirred and heated to a temperature of from about 45° C. to about 65° C., in embodiments of from about 48° C. to about 63° C., resulting in toner aggregates of from about 4 microns to about 8 microns in volume average diameter, and in embodiments of from about 5 microns to about 7 microns in volume average diameter.

In embodiments, a coagulant may be added during or prior to aggregating the latex, the aqueous colorant dispersion, and the wax dispersion. Examples of coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like. The coagulant may be added over a period of time from about 1 to about 5 minutes, in embodiments from about 1.25 to about 3 minutes. The coagulant may be added in amounts from about 0.02 to about 0.3 percent by weight of the toner, and in embodiments from about 0.05 to about 0.2 percent by weight of the toner.

Once the desired final size of the particles is achieved with a volume average diameter of from about 4 microns to about 9 microns, and in embodiments of from about 5.6 microns to about 8 microns, the pH of the mixture may be adjusted with a base to a value of from about 4 to about 7, and in embodiments from about 6 to about 6.8. Any suitable base may be used such as, for example, alkali metal hydroxides such as, for example, sodium hydroxide, potassium hydroxide, and ammonium hydroxide. The alkali metal hydroxide may be added in amounts from about 6to about 25 percent by weight of the mixture, in embodiments from about 10 to about 20 percent by weight of the mixture.

After adjustment of the pH, in embodiments an organic sequestering agent may be added to the mixture. Such sequestering agents and their use in forming toners are described, for example, in U.S. Pat. No. 7,037,633, the disclosure of which is hereby incorporated by reference in its entirety.

Other processes for obtaining resin particles include those produced by a polymer microsuspension process as disclosed in U.S. Pat. No. 3,674,736, the disclosure of which is hereby incorporated by reference in its entirety, a polymer solution microsuspension process as disclosed in U.S. Pat. No. 5,290,654, the disclosure of which is hereby incorporated by reference in its entirety, and mechanical grinding processes, or other processes within the purview of those skilled in the art.

The toner may also include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after preparation of the parent toner, for example, by grinding, classifying in the conventional melt mix process, or by washing and drying in the emulsion aggregation process. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

In embodiments, additives may be added to toner particles of the present disclosure and mixed, such as by conventional blending. The mixing process by which the toner may be combined with surface additives may, in embodiments, be both a low energy and low intensity process. This mixing process can include, but is not limited to, tumble blending, blending with Henschel mixers (sometimes referred to as Henschel blending), agitation using a paint style mixer, and the like. Effective mixing can also be accomplished within the toner cartridge/bottle by shaking by hand.

In embodiments, mixing may occur by the use of blenders, such as a Henschel 600L, Henschel 75L, Henschel 10L, and the like. The exact blending parameters will vary depending upon the composition of the toner utilized, that is, the binder resin, pigment, additive package, and the like.

Toner in accordance with the present disclosure can be used in a variety of imaging devices including printers, copy machines, and the like. The toners generated in accordance with the present disclosure are excellent for imaging processes, especially xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

The imaging process includes the generation of an image in an electronic printing apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat. Nos. 4,937,166 and 4,935,326, the disclosures of each of which are hereby incorporated by reference in their entirety. The toner-to-carrier mass ratio of such developers may be from about 2 to about 20 percent, and in embodiments from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins, fluoropolymers, mixtures of resins not in close proximity in the triboelectric series, thermosetting resins, and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by a magnetic brush development process as disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

In embodiments, color images can be produced utilizing the electrophotographic marking process. One type of color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the receiver, a previously toned image may be scavenged by subsequent development if interacting development systems are used. Thus, for the IOI process, there may be a need for scavengeless or noninteractive development systems.

In embodiments, hybrid scavengeless development (HSD) technology may be utilized. HSD technology develops toner via a conventional magnetic brush onto the surface of a donor roll. A plurality of electrode wires may be closely spaced from the toned donor roll in the development zone. An AC voltage may be applied to the wires to generate a toner cloud in the development zone. This donor roll generally includes a conductive core covered with a thin, for example from about 50 to about 200 μm, partially conductive layer. The magnetic brush roll may be held at an electrical potential difference relative to the donor core to produce the field necessary for toner development. The toner layer on the donor roll may then be disturbed by electric fields from a wire or set of wires to produce and sustain an agitated cloud of toner particles. In embodiments, AC voltages of the wires relative to the donor may be from about 700 to about 900 Vpp at frequencies of from about 5 to about 15 kHz. These AC signals may often be square waves, rather than pure sinusoidal waves. Toner from the cloud is then developed onto the nearby photoreceptor by fields created by a latent image.

In accordance with the present disclosure, while any suitable electrostatic image development device may be used, it may be desirable to use a device employing the hybrid scavengeless development system. Such a system is described in, for example, U.S. Pat. No. 5,978,633, the disclosure of which is hereby incorporated by reference in its entirety.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLES

Example 1

A dual component magenta pigment composition of the present disclosure was prepared by melt mixing together a first component of a dispersion of about 30 percent by weight of PR 81:2 in a propoxylated bisphenol A fumarate resin, a second component of a dispersion of about 30 percent by weight of PR 57:1 in a propoxylated bisphenol A fumarate resin, a third component of a propoxylated bisphenol A fumarate resin, and a fourth component of a cross-linked propoxylated bisphenol A fumarate resin having a gel content of about 30 percent by weight. Prior to melt mixing, all components were combined by tumble blending in the amounts set forth below in Table 1 to form dual pigment compositions of the present disclosure. The compositions had varying ratios of first pigment to second pigment, as well as varying levels of total pigment in toner. The fourth component input amount was kept constant at 15.7% by weight. The resulting toners (designated A-K in Table 1 below) were as follows:

TABLE 1

| | | Ratio of PR81:2 to PR57:1 | | | | |
|---|---|---|---|---|---|---|
| | | 0/100 | 40/60 | 60/40 | 80/20 | 100/0 |
| Total % Pigment | 5.5 | | B | E | H | |
| | 7 | A | C | F | I | K |
| | 8.5 | | D | G | J | |

The toners also possessed about 3.5 percent by weight of silica treated with a coating of hexamethyldisilazane (15%) and y-amino trimethoxy silane 3%), about 1.55 percent by weight of decyl trimethoxysilane (DTMS) treated titania with a 40 nanometer average particle diameter (SMT-5103, available from Tayca Corporation), and about 0.5 percent of zinc stearate, available from Ferro Corporation. The toner had a volume median particle size of about 8.3 μm with percent fines less than about 5 μm of no more than about 15 percent by number as measured by a Coulter Counter.

The toners prepared above were formed into developers by combining a toner with a carrier having about a 80 μm diameter steel core (supplied by North American Höganäs) coated at about 230° C. with about 1 percent by weight of PMMA (supplied by Soken). A single pigment toner, which utilized the same fumarate resin combinations as described above but possessed about 7.9% PR 81:2 by weight as a colorant, was prepared and used for comparison.

Thereafter, the triboelectric charge on the toner particles was determined by the known Faraday Cage process. The developer was aggressively mixed in a paint shaker (Red Devil 5400, modified to operate between about 675 and about 725 RPM) for a period of about 20 minutes. It was believed that this process simulated a mechanical energy input to a toner particle equivalent to that applied in a xerographic housing environment in a low toner throughput mode, that is, a xerographic housing producing a print in which from about 0 to about 2 percent of the print was covered by toner developed from that housing for a period of about 100 to about 10,000 impressions. After about 20 minutes, the tribo for the toners prepared above was from about −32 to about −40 microcoulombs per gram, which is similar to the tribo values of magenta toner containing about 7.9% PR 81:2.

A spectrum of the charge distribution was obtained of the developer using the known charge spectrograph, as disclosed in U.S. Pat. No. 4,375,673, the disclosure of which is hereby incorporated by reference in its entirety. The charge spectra for the toner from these developers when expressed as particle number (y-axis) plotted against toner charge divided by the toner diameter (x-axis) consisted of one or more peaks, and the toner charge divided by diameter (referred to as toner Q/D value (values) at the particle number maximum (maxima)) served to characterize the developers. The developers prepared in this Example were similar to the developer prepared with a magenta toner containing about 7.9% PR 81:2, in terms of charge distribution. Red colors obtained with an iGEN xerographic machine from Xerox Corporation using about 100% solid overlays of a magenta toner containing about 7.9% PR 81:2 and yellow toner at nominal developed mass per unit area (DMA) targets may possess an L* of greater than about 49 and a hue angle of about 33 degrees. The resulting color was significantly lighter than the SWOP® standards or the GRACoL® standards, or the reds produced by competing offset and non-impact printing technologies.

Selected toners (C, D, G, I, and J from Table 1 above) were machine tested at 2 magenta developed mass per unit area (DMA) targets and 2 yellow developed mass per unit area targets. SWOP red prints were evaluated. Measurement of the color gamut was characterized by CIE (Commission International de l'Eclairage) specifications, commonly referred to as CIE-Lab, where L*, a* and b* are the modified opponent color coordinates forming a 3 dimensional space. L* characterizes the lightness of a color, a* approximately characterizes the redness, and b* approximately characterizes the yellowness of a color. The CIE-Lab system is useful as a three-dimensional system for the quantitative description of color loci. On one axis in the system the colors green (negative a* values) and red (positive a* values) are plotted, on the axis at right angles thereto the colors blue (negative b* values) and yellow (positive b* values) are plotted. The value C*, further defined as the color saturation, is composed of a* and b* as follows: $C^*=(a^{*2}+b^{*2})^{0.5}$ and is used to describe violet color loci. The two axes intersect one another at the achromatic point. The vertical axis (achromatic axis) is relevant for the lightness, from white (L*=100) to black (L*=0). All of these parameters may be measured with an industry standard spectrophotometer, for instance, a Gretag Macbeth 7000A Color eye spectrophotometer from X-Rite Corporation. Using the CIE-Lab system it is thus possible to describe not only color loci but also color spacings, by stating the three coordinates.

Figure 2:
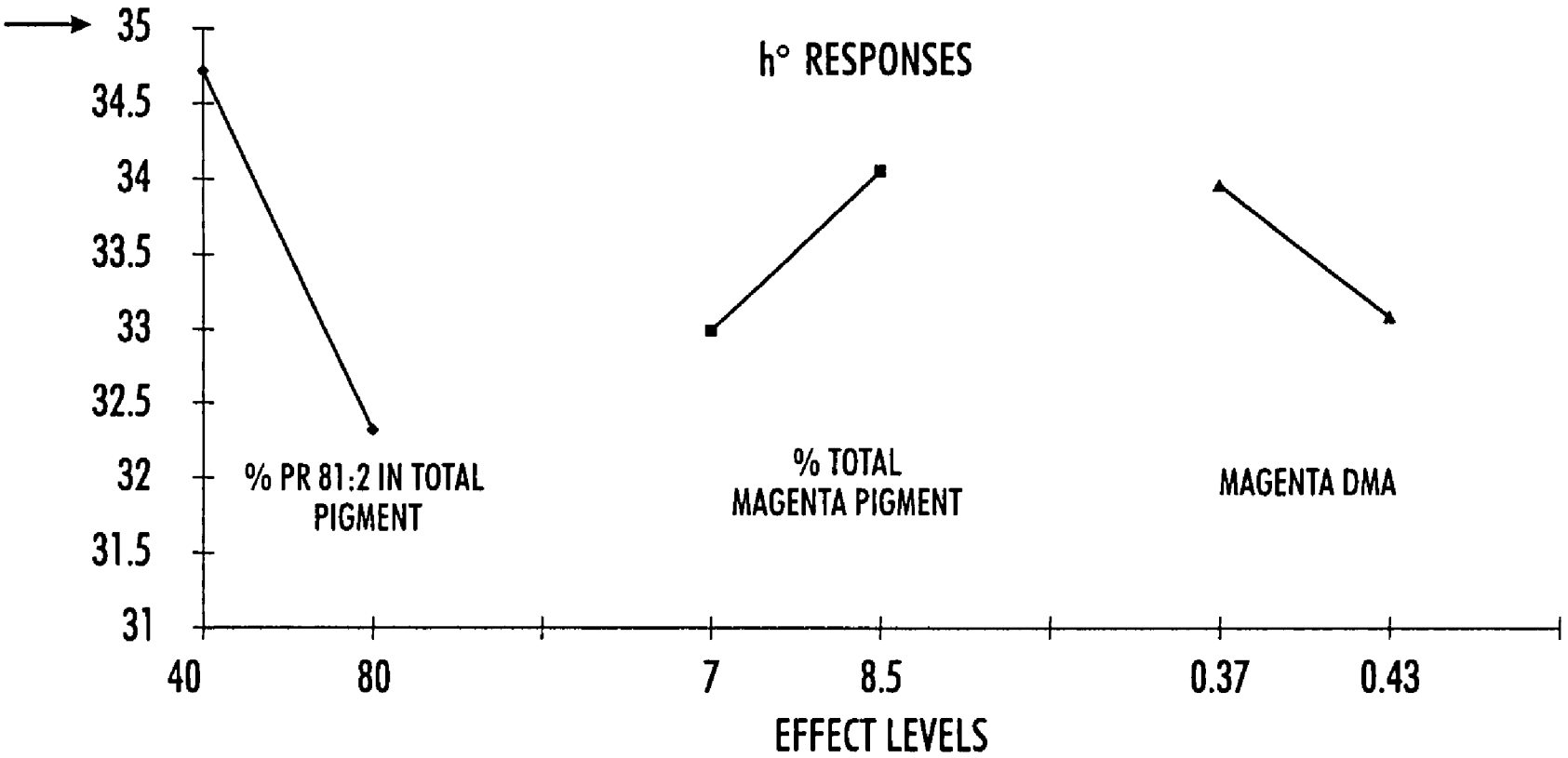
FIG. 2 is a graph depicting marginal means plots of hue ($h^o$) for a magenta toner possessing dual pigment compositions of the present disclosure.
Figure 3:
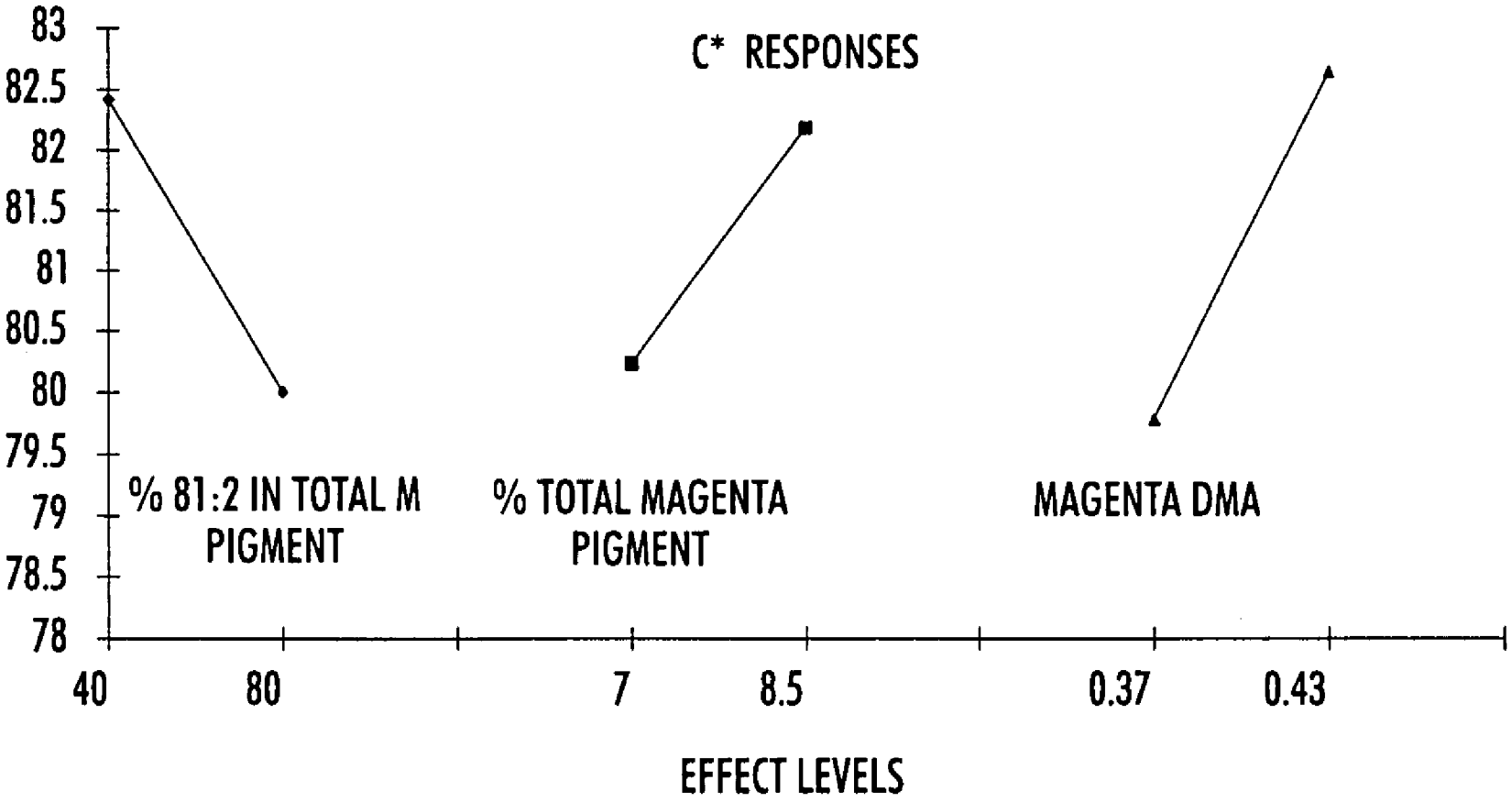
FIG. 3 is a graph depicting marginal means plots of color saturation (C*) for a magenta toner possessing dual pigment compositions of the present disclosure.

The analyzed responses (marginal means) for L*, hue ($h^o$), and color saturation (C*) are shown in FIGS. 1-3, respectively. For all three responses, ratio of PR81:2/PR57:1 pigments, total pigment concentration, and magenta DMA were significant drivers. The GRACoL red aim target for the L* and $h^o$ values are shown by the horizontal arrows next to the Y-axis of the figures and are contained within the range of values spanned in the matrix. While a target was not defined for C*, higher C* values were more desirable for this particular application.

Figure 4:
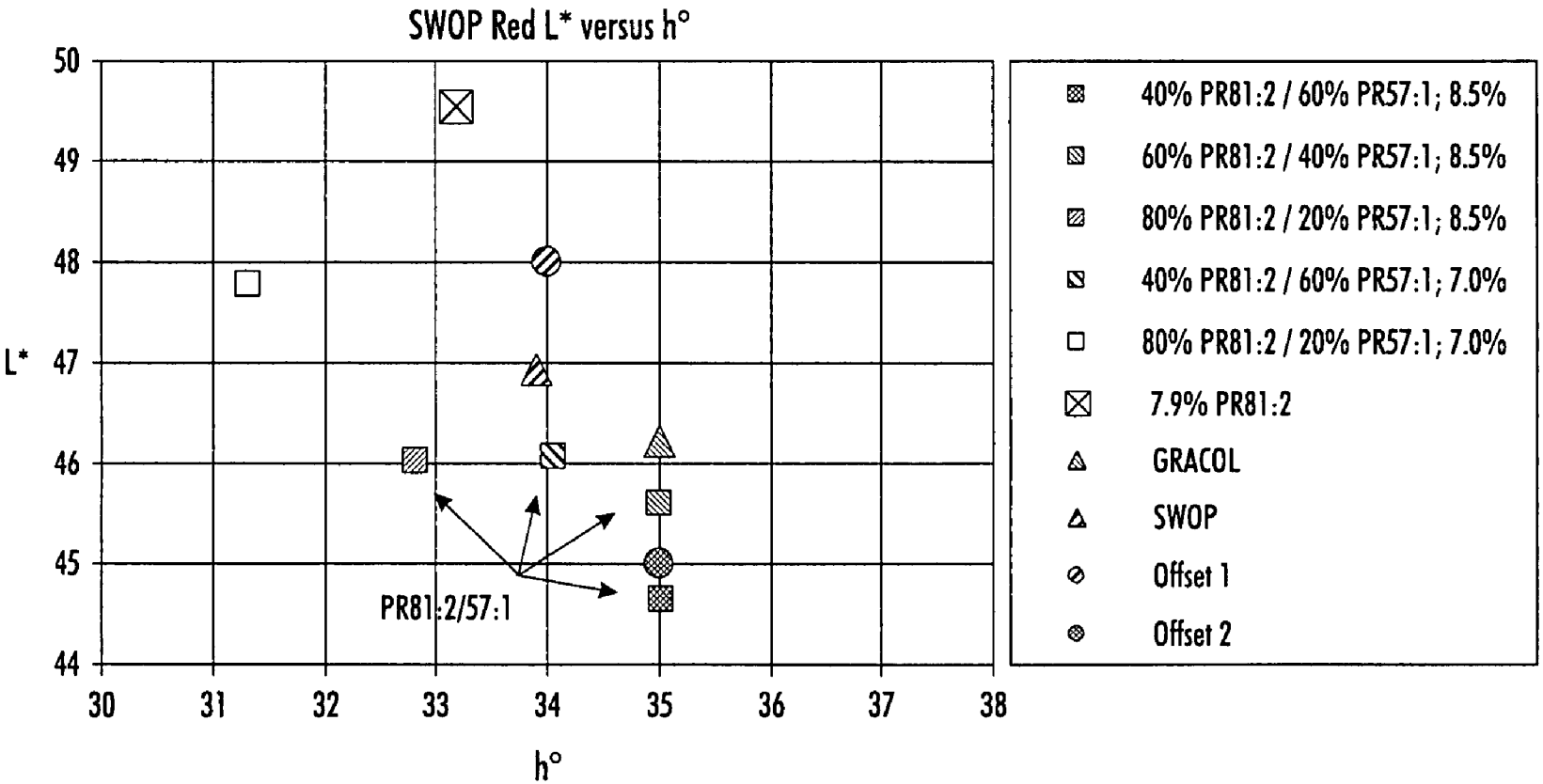
FIG. 4 is a graph depicting specific $h^o$ and L* values for magenta toners prepared with dual pigment compositions of the present disclosure.

The results of these tests indicate that by using the PR81:2/PR57:1 combination, the GRACoL red, which had L* and $h^o$ much closer to offset performance, was achieved. The specific $h^o$ and L* values for the toners are shown in FIG. 4.

The color difference of the toners from GRACoL red standards was also determined. The color difference $\Delta E_{00}$ can be determined from the following expression:

$$\text{Color difference } \Delta E=((95-L^*)^2+(0-a^*)^2+(0-b^*)^2)^{1/2},$$

utilizing correction factors within the purview of those skilled in the art.

The PR81:2/PR57:1 combination in a toner allowed a closer match to the GRACoL red, with lower $\Delta E_{00}$, compared to toner containing only about 7.9% PR 81:2.

Comparative Example 1

Toners were also made following the procedures set forth above in Example 1 with combinations of PR122 (a quinacridone pigment) and PR57:1. The toners were prepared by melt mixing together a first component of a dispersion of about 30 percent by weight of PR 122 in a propoxylated bisphenol A fumarate resin, a second component of a dispersion of about 30 percent by weight of PR 57:1 in a propoxylated bisphenol A fumarate resin, a third component of a propoxylated bisphenol A fumarate resin, and a fourth component of a cross-linked propoxylated bisphenol A fumarate resin having a gel content of about 30 percent by weight. Prior to melt mixing, the components were combined by tumble blending to form PR122 to PR57:1 at a ratio of about 60:40.

The amounts of the first, second, and the third components were varied to form respective toners with total pigment level of about 6, 9 and 12 percent by weight. Input amount of the fourth component was kept constant at about 15.7% by weight.

The chroma of the pigment combination was determined by a Gretag Macbeth 7000A Color eye spectrophotometer and found to be about 3 to about 5 units below that of the PR81:2/57:1 combination of Example 1. The reduced chroma may lead to inferior color reproduction, for example, through a smaller achievable engine gamut and a reduced number of PANTONE® colors that can be reproduced. (The PANTONE® colors refer to one of the most popular color guides illustrating different colors, wherein each color is associated with a specific formulation of colorants, and is published by PANTONE, Inc. of Moonachie, N.J.)

Thus, the dual pigment composition of the present disclosure produced in Example 1 was superior in color reproducibility.

Example 2

Figure 5:
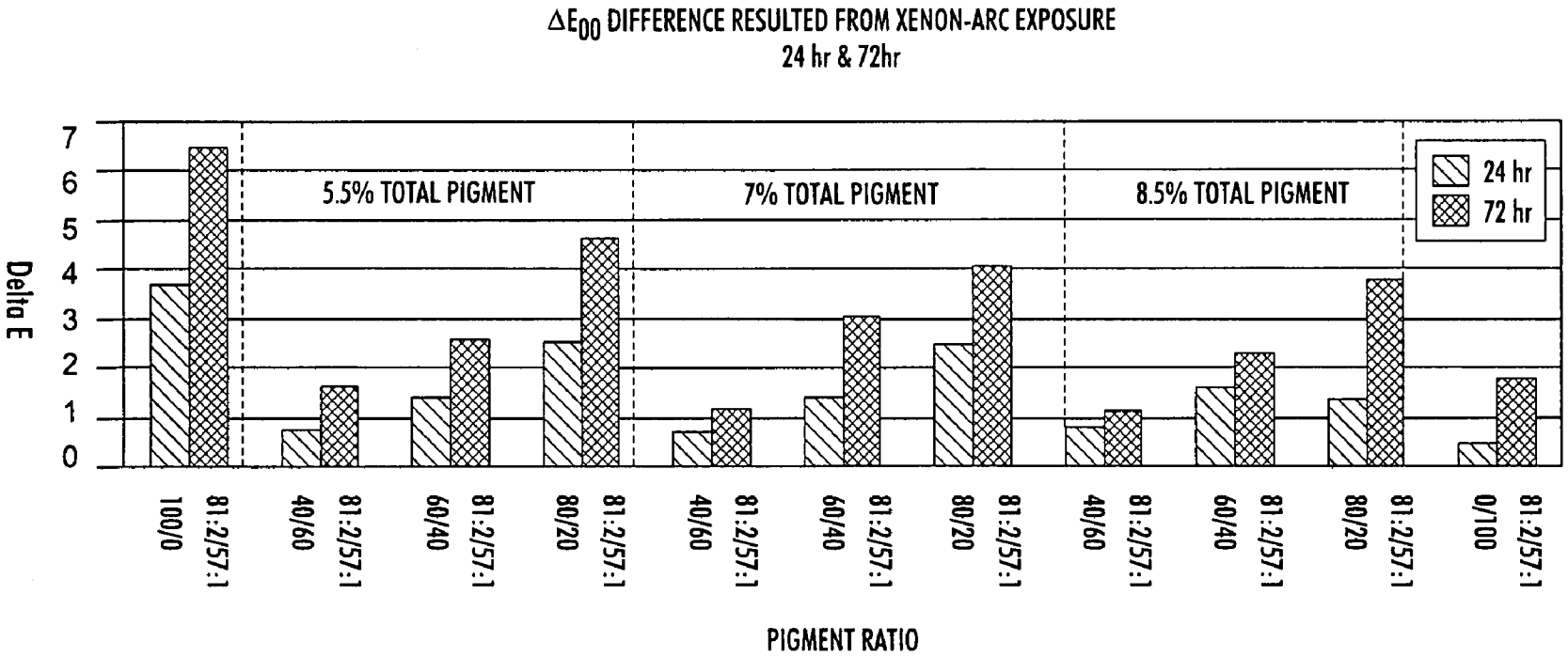
FIG. 5 is a graph depicting lightfastness properties of magenta toners prepared with dual pigment compositions of the present disclosure.

Additionally, the dual pigment toners prepared in Example 1 were evaluated for magenta lightfastness using about 24 hour and about 72 hour Xenon-ARC light exposure. Toner mass equivalent to about 0.45 DMA was uniformly deposited onto a paper substrate by wet deposition and fused using an envelope fuser. The paper patches were exposed to Xenon-ARC by using a fadeometer, model 25-FR manufactured by Atlas Electric Devices Company of Chicago, Ill. The color difference $\Delta E_{00}$ of patches before and after the light exposure was determined using the Gretag Macbeth 7000A Color eye spectrophotometer. The data for wet depositions of the toners are shown in FIG. 5. The data obtained agree very well with the data from the prints obtained in Example 1.

For all samples the L*a*b* values of the CIE-Lab system were determined by the Gretag Macbeth 7000A Color eye spectrophotometer. As set forth in FIG. 5, the PR81:2/57:1 toners gave much better lightfastness than a magenta toner possessing PR81:2 alone. Additionally, the lightfast response was not linear with respect to the PR81:2/57:1 pigment ratio. At 60% PR81:2/40% PR57:1 pigment ratio, more than 50% of the PR57:1 lightfast benefit was realized. Without wishing to be bound by any theory, this may be due to the fact that the color shift for the PR81:2 and PR57:1 were in somewhat different directions: the PR81:2 shifted to lower L* and higher b* while the PR57:1 shifted to higher L* and lower b* with exposure.

Figure 6:
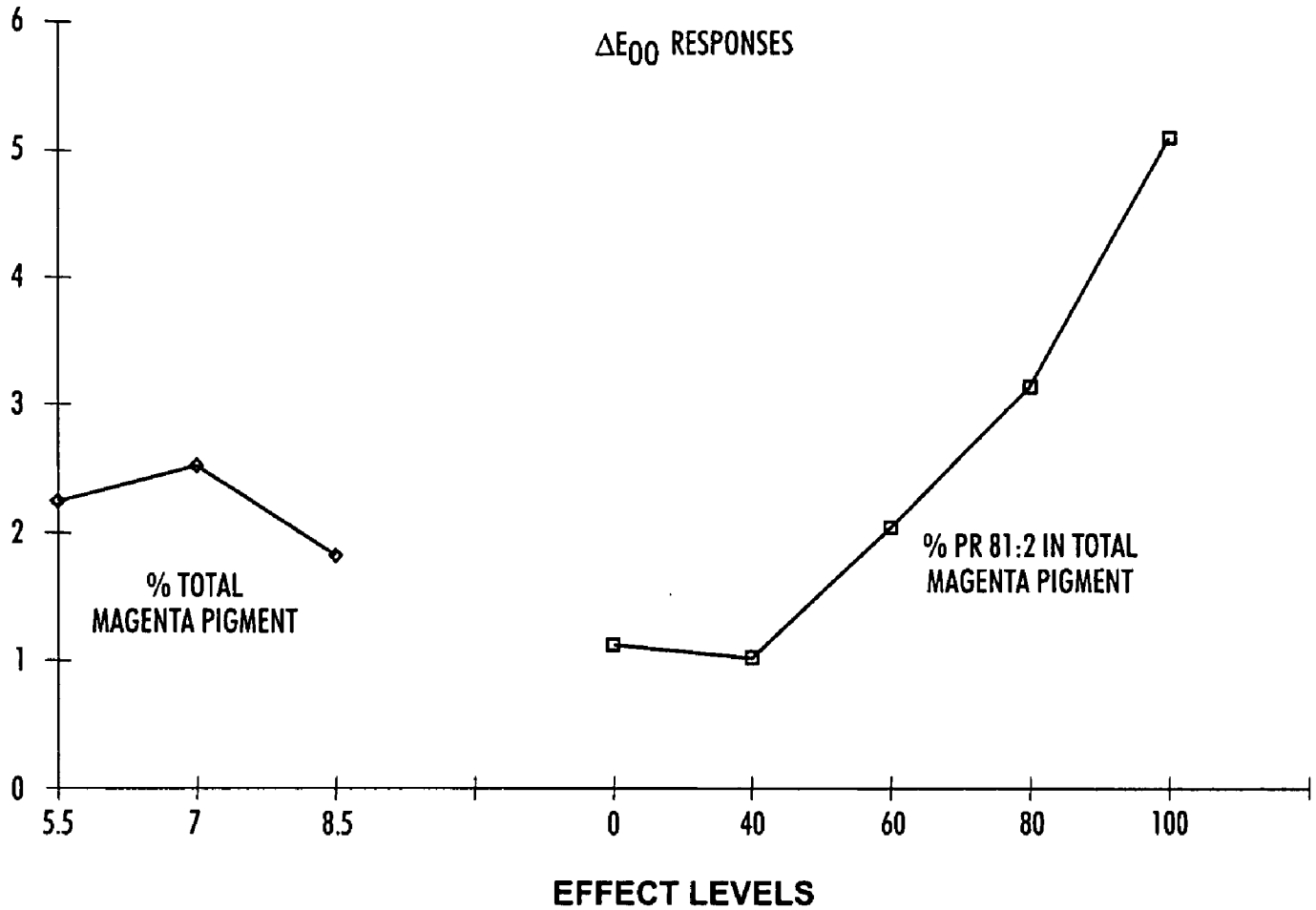
FIG. 6 is a graph depicting color difference ($\Delta E_{00}$) of a dual pigment composition of the present disclosure.

A graph depicting color difference ($\Delta E_{00}$) is set forth as FIG. 6. The competing directions in the color shifts combined to provide a lightfastness level comparable to commercially available magenta toners. The lightfastness predictions for about 72 hour Xenon-ARC exposure of toners with about 8.5% total pigment concentration are set forth below in Table 3. The 50/50 combination, with a $\Delta E_{00}$ of about 1.59, had essentially equivalent performance to 100% PR57:1 (magenta toner pigment for a competing xerographic machine targeting offset market), which had a $\Delta E_{00}$ of about 1.40. Additionally, the 50/50 combination had similar performance to the toner optimized for overall color response, which had 60% PR81:2, was only marginally worse (2.17 $\Delta_{00}$). An overview of the data is set forth below in Table 2.

TABLE 2

| % PR81:2 | $\Delta E_{00}$ | Delta L* | Delta a* | Delta b* | Delta C* | Delta H° |
|---|---|---|---|---|---|---|
| 0 | 1.40 | 0.36 | 1.74 | 5.02 | 2.18 | 4.37 |
| 10 | 1.07 | 0.43 | 1.75 | 3.91 | 1.91 | 2.99 |
| 20 | 0.93 | 0.5 | 1.97 | 2.62 | 1.96 | 1.61 |
| 30 | 0.96 | 0.56 | 2.4 | 1.15 | 2.31 | 0.23 |
| 40 | 1.18 | 0.63 | 3.05 | −0.5 | 2.96 | −1.15 |
| 50 | 1.59 | 0.7 | 3.92 | −2.32 | 3.92 | −2.53 |
| 60 | 2.17 | 0.77 | 5 | −4.32 | 5.19 | −3.9 |
| 70 | 2.94 | 0.84 | 6.29 | −6.51 | 6.76 | −5.28 |
| 80 | 3.88 | 0.9 | 7.8 | −8.87 | 8.64 | −6.66 |
| 90 | 5.01 | 0.97 | 9.53 | −11.4 | 10.82 | −8.04 |
| 100 | 6.32 | 1.04 | 11.47 | −14.12 | 13.31 | −9.42 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

at least one binder resin comprising a combination of a linear propoxylated bisphenol A fumarate and a cross-linked pronoxylated bisphenol A fumarate; and a dual pigment composition comprising a first pigment comprising a xanthene dye and a second pigment comprising a monoazo dye, wherein the ratio of the first pigment to the second pigment is from about 30:70 to about 80:20.

2. The toner according to claim 1, wherein the toner further comprises at least one additive selected from the group consisting of surfactants, coagulants, surface additives, and mixtures thereof.

3. The toner according to claim 2, wherein the toner comprises an emulsion aggregation toner and the at least one additive is from about one to about twenty additives selected from the group consisting of metal salts, metal salts of fatty acids, colloidal silicas, metal oxides, strontium titanates, and combinations thereof.

4. The toner according to claim 1, wherein the linear propoxylated bisphenol A fumarate comprises from about 70% by weight to about 98% by weight of the binder resin and the cross-linked propoxylated bisphenol A fumarate comprises from about 2% by weight to about 30% by weight of the binder resin.

5. The toner according to claim 1, wherein the first pigment is selected from the group consisting of C.I. Pigment Red 81:2, C.I. Pigment Red 81:1, C.I. Pigment Red 81:3, C.I. Pigment Red 81:4, C.I. Pigment Red 81:5, C.I. Pigment Red 81:6, and combinations thereof, and the second pigment is selected from the group consisting of C.I. Pigment Red 57:1, C.I. Pigment Red 57, C.I. Pigment Red 57:2, C.I. Pigment Red 57:3 and combinations thereof.

6. The toner according to claim 1, wherein the first pigment comprises C.I. Pigment Red 81:2 and the second pigment comprises C.I. Pigment Red 57:1.

7. The toner according to claim 1, wherein the weight ratio of the first pigment to the second pigment is from about 40:60 to about 70:30.

8. A toner comprising:

at least one binder resin comprising a combination of a liner propoxylated bisphenol A fumarate and a cross-linked propoxylated bisphenol A fumarate; and a dual pigment composition comprising C.I. Pigment Red 81:2 and C.I. Pigment Red 57:1, wherein the weight ratio of C.I. Pigment Red 81:2 to C.I. Pigment Red 57:1 is from about 30:70 to about 80:20.

9. The toner of claim 8, wherein the binder resin comprises a combination of a liner propoxylated bisphenol A fumarate in an amount from about 85% by weight to about 95% by weight of the binder resin, and a cross-linked propoxylated bisphenol A fumarate in an amount from about 5% by weight to about 15% by weight of the binder resin.

10. The toner according to claim 8, wherein the weight ratio of C.I. Pigment Red 81:2 to C.I. Pigment Red 57:1 is from about 40:60 to about 70:30, and the toner further comprises at least one additive selected from the group consisting of surfactants, coagulants, surface additives, and mixtures thereof.

* * * * *